US008096794B2

(12) United States Patent
Iwanami et al.

(10) Patent No.: US 8,096,794 B2
(45) Date of Patent: Jan. 17, 2012

(54) COMPRESSOR WITH OIL SEPARATION AND STORAGE

(75) Inventors: Shigeki Iwanami, Okazaki (JP); Hiroyasu Kato, Kariya (JP); Yasuhiro Oki, Okazaki (JP); Yoichiro Kawamoto, Nagoya (JP)

(73) Assignees: Denso Corporation, Kariya (JP); Nippon Soken, Inc., Nishio-shi (JP)

( * ) Notice: Subject to any disclaimer, the term of this patent is extended or adjusted under 35 U.S.C. 154(b) by 903 days.

(21) Appl. No.: 12/076,095

(22) Filed: Mar. 13, 2008

(65) Prior Publication Data

US 2008/0226483 A1 Sep. 18, 2008

(30) Foreign Application Priority Data

Mar. 15, 2007 (JP) ..... 2007-67017
Mar. 15, 2007 (JP) ..... 2007-67101
Jun. 25, 2007 (JP) ..... 2007-166657
Jun. 27, 2007 (JP) ..... 2007-169269
Jun. 27, 2007 (JP) ..... 2007-169290

(51) Int. Cl.
*F01C 21/04* (2006.01)
*F04C 15/00* (2006.01)
*F04C 29/02* (2006.01)
*F01C 1/02* (2006.01)

(52) U.S. Cl. .... 418/97; 418/55.6; 418/100; 418/DIG. 1; 210/512.1

(58) Field of Classification Search ..... 418/55.1–55.6, 418/DIG. 1, 97, 83, 99, 100, 270; 210/512.1, 210/787–789
See application file for complete search history.

(56) References Cited

U.S. PATENT DOCUMENTS 3,945,216 A * 3/1976 Schibbye ..... 418/97
4,676,075 A * 6/1987 Shiibayashi ..... 418/55.6
4,889,471 A * 12/1989 Izunaga et al. ..... 418/55.6
5,545,021 A * 8/1996 Fukuoka et al. ..... 418/97
5,697,771 A * 12/1997 Arndt et al. ..... 418/97
6,227,831 B1 * 5/2001 Osima et al. ..... 418/55.4
6,428,295 B1 * 8/2002 Kobayashi et al. ..... 418/99
6,511,530 B2 * 1/2003 Iwanami et al. ..... 96/189
6,554,595 B2 * 4/2003 Hida et al. ..... 418/201.1
6,599,101 B2 * 7/2003 Matsuura et al. ..... 417/313
7,018,184 B2 * 3/2006 Skinner et al. ..... 418/55.1
7,281,912 B2 * 10/2007 Kudo ..... 418/55.6
7,438,536 B2 * 10/2008 Ito ..... 417/312

(Continued)

FOREIGN PATENT DOCUMENTS

JP U-58-45989 3/1983

(Continued)

OTHER PUBLICATIONS

Office Action dated Dec. 25, 2008 in corresponding Japanese patent application No. 2007-067101 (and English translation).

(Continued)

*Primary Examiner* — Mary A Davis
(74) *Attorney, Agent, or Firm* — Posz Law Group, PLC

(57) ABSTRACT

A compressor comprises an oil separator for separating oil from a refrigerant compressed by a compression mechanism unit, and a high-pressure oil storage chamber for storing the oil separated by the oil separator. At least a portion of the oil separator is provided outside a housing. The high-pressure oil storage chamber has an outer wall that is thicker than the outer wall of the housing accommodating the compression mechanism unit, and an end wall of the housing is formed by this thicker outer wall.

3 Claims, 13 Drawing Sheets

U.S. PATENT DOCUMENTS

| | | | | |
|---|---|---|---|---|
| 7,462,021 | B2 * | 12/2008 | Ebara et al. | 418/60 |
| 7,537,436 | B2 * | 5/2009 | Kitamura et al. | 417/313 |
| 7,566,210 | B2 * | 7/2009 | Elson et al. | 418/55.6 |
| 7,708,537 | B2 * | 5/2010 | Bhatia et al. | 418/55.6 |
| 7,731,486 | B2 * | 6/2010 | Yokoyama | 418/55.6 |
| 7,736,136 | B2 * | 6/2010 | Ohtake | 418/55.6 |
| 2005/0129536 | A1 * | 6/2005 | Ohtake | 417/313 |
| 2005/0169787 | A1 | 8/2005 | Iguchi et al. | |
| 2006/0117790 | A1 * | 6/2006 | Dieterich | 62/467 |
| 2006/0216182 | A1 | 9/2006 | Kohsokabe et al. | |

FOREIGN PATENT DOCUMENTS

| | | | |
|---|---|---|---|
| JP | U-58-57593 | | 4/1983 |
| JP | U-61-99691 | | 6/1986 |
| JP | A-61-205386 | | 9/1986 |
| JP | 62191690 | A * | 8/1987 |
| JP | A-01-155087 | | 6/1989 |
| JP | U-05-993 | | 1/1993 |
| JP | A-07-133779 | | 5/1995 |
| JP | A-08-028465 | | 1/1996 |
| JP | A-10-37883 | | 2/1998 |
| JP | A-2000-186683 | | 7/2000 |
| JP | A-2001-207980 | | 8/2001 |
| JP | 2004060605 | A * | 2/2004 |
| JP | A-2004-060605 | | 2/2004 |
| JP | A-2004-177020 | | 6/2004 |
| JP | A-2004-211550 | | 7/2004 |
| JP | A-2005-120970 | | 5/2005 |
| JP | A-2005-201114 | | 7/2005 |
| JP | A-2006-241982 | | 9/2006 |
| JP | A-2006-266170 | | 10/2006 |
| JP | A-2006-348952 | | 12/2006 |
| WO | WO 2004/010001 | | 1/2004 |

OTHER PUBLICATIONS

Office Action dated Dec. 25, 2008 in corresponding Japanese patent application No. 2007-067017 (and English translation).

Office Action dated Jan. 30, 2009 in corresponding Japanese patent application No. 2007-169269 (and English translation).

Office Action dated Jan. 21, 2009 in corresponding Japanese patent application No. 2007-169290 (and English translation).

* cited by examiner

COMPRESSOR WITH OIL SEPARATION AND STORAGE

TECHNICAL FIELD

The present invention relates to a compressor having an oil separator and a high-pressure oil storage chamber, and more specifically to a scroll-type compressor that uses carbon dioxide ($CO_2$) as a refrigerant.

BACKGROUND ART

Scroll-type compressors are known in the prior art for use in refrigerators, air conditioners, etc. In some prior known compressors of this type, in order to prevent lubricating oil mixed in the refrigerant from being fed into the refrigeration cycle system, the oil is separated from the refrigerant while the compressed refrigerant is temporarily in the compressor's discharge chamber, and the separated oil is supplied to sliding parts, etc., in the compression mechanism unit by utilizing the pressure differential that is created between the discharge pressure (high pressure) and the intake pressure (low pressure) or their intermediate pressure which does not require power, thus eliminating the need for an oil pump or the like that requires power to operate.

In one such compressor, it is known as disclosed, for example, in Japanese Unexamined Patent Publication No. 2004-177020, to provide an oil separator outside the compressor and circulate the oil separated from the refrigerant back to the compressor after using the heat of the oil on the heat pump cycle side.

On the other hand, Japanese Unexamined Patent Publication No. 2006-266170 discloses a scroll compressor comprising a compression mechanism unit accommodated in a housing constructed as a sealed container, an oil separator for separating oil mixed in a refrigerant, and a high-pressure oil storage chamber for storing the separated oil, wherein the oil is fed from the high-pressure oil storage chamber back to the compression mechanism unit accommodated in the housing.

Further, Japanese Unexamined Patent Publication No. 2001-207980 discloses a compressor in which a compressor unit and a driving means are enclosed in a housing with a concave-shaped partition separating one from the other.

Of these compressor component elements, an invention concerning the oil separator is disclosed, for example, in Japanese Unexamined Patent Publication No. 2004-211550, in which the oil separator is contained within the housing of the compressor.

According to such structure, not only can the oil be prevented from flowing into the cycle and the cycle efficiency increased, but the reliability of the compressor can also be increased because the oil can be stored within the compressor.

On the other hand, Japanese Unexamined Patent Publication No. H10-37883 discloses an invention in which the oil separator is constructed separately from the compressor proper.

Further, of the compressor component elements, there is disclosed, as in the above-cited Japanese Unexamined Patent Publication No. 2004-211550, an invention concerning the high-pressure oil storage chamber in which the high-pressure oil storage chamber is contained within the housing of the compressor.

In the compressor disclosed in above-cited Japanese Unexamined Patent Publication No. 2004-211550, the high-pressure oil storage chamber is located adjacent to the discharge chamber in the compression mechanism unit within the housing where the oil separator is also contained. However, this has a problem that the compression mechanism unit, and hence the refrigerant drawn therein, is heated by the heat of the high-temperature, high-pressure oil, causing degradation of compressor efficiency. Furthermore, since the high-pressure oil storage chamber has to be placed below the oil separator, this compressor has a disadvantage that the oil storage capacity is small and a sufficient amount of oil cannot be stored.

In view of this, the applicant has previously proposed a scroll compressor in which a partition wall is provided so as to form a space between the compression mechanism unit and the high-pressure oil storage chamber within the container, thereby enhancing the performance by the resulting heat insulating effect while at the same time securing a sufficient oil storage capacity.

As described above, the compressor has problems yet to be overcome or alleviated as follows:

(1) Since the high-temperature oil in storage is in contact with the compressor proper, the gas drawn therein is heated, causing degradation of compressor performance.

(2) When the oil separator is contained within the housing, the area subjected to high temperatures within the housing increases, and the efficiency drops because the introduced refrigerant is heated; furthermore, since the oil storage unit has to be placed below the separation cylinder of the oil separator, the oil storage capacity decreases.

(3) When the oil separator is constructed separately from the compressor proper, the overall size of the compressor system increases because the compressor, oil separator, and accumulator are constructed as separate units.

(4) When a partition wall is provided so as to form a space between the compression mechanism unit and the high-pressure oil storage chamber within the container, since the interior of the heat insulating space is at a low pressure, the partition wall is slightly deformed due to the pressure from the high-pressure oil storage chamber. This deformation of the partition wall can lead to a breakage of the connecting portion between the oil return passage and the partition wall, causing the lubricating oil to leak from the high-pressure oil storage chamber.

(5) When $CO_2$ is used as the refrigerant, since the housing is used in a high-pressure environment, the compressor unit and the driving means, both in a relatively low-pressure environment, are strained due to the high-pressure space separated by the partition wall.

Furthermore, when the high-pressure oil storage chamber is constructed integrally with the relatively low-pressure housing, since a partition wall having sufficient strength has to be provided, the overall size increases, and in addition, the joining portion between the high-pressure oil storage chamber and the low-pressure housing is strained and the joining strength decreases.

An object of the present invention is to solve the above problems.

DISCLOSURE OF THE INVENTION

According to the present invention, a compressor is provided which is constructed by enclosing a compression mechanism unit for compressing a refrigerant in a housing whose interior is held at a lower pressure than a discharge pressure, the compressor comprising: an oil separator for separating oil from the refrigerant compressed by the compression mechanism unit; and a high-pressure oil storage chamber, located adjacent to the compression mechanism unit, for storing the oil separated by the oil separator, wherein at least a portion of the oil separator is provided outside the housing.

According to one aspect of the invention, the compression mechanism unit and the oil separator are connected in a communicating fashion by a discharge pipe installed passing through the compression mechanism unit.

According to another aspect of the invention, the high-pressure oil storage chamber has an outer wall that is thicker than an outer wall forming the housing accommodating the compression mechanism unit, and an end wall of the housing is formed by the thicker outer wall.

According to another aspect of the invention, the oil separator comprises: a separation cylinder; a connecting pipe, installed passing through the housing and connected to an upper portion of the separation cylinder, for introducing the refrigerant discharged from the compression mechanism unit tangentially into the separation cylinder; and a separation pipe, mounted in the upper portion of the separation cylinder, for delivering the refrigerant to an external refrigerant circuit after the oil is removed, wherein a lower portion of the separation cylinder is provided with an exit hole communicating with the high-pressure oil storage chamber.

According to another aspect of the invention, the separation pipe mounted in the oil separator is disposed outside the housing.

According to another aspect of the invention, a lower end of the oil separator is located inside the housing.

According to another aspect of the invention, the oil separator is entirely located outside the housing.

According to another aspect of the invention, the high-pressure oil storage chamber is constructed from a pressure-resistant container whose wall thickness is greater than an outer wall forming the housing accommodating the compression mechanism unit and, within the housing, a space in which oil is not filled is formed between the compression mechanism unit and the pressure-resistant container forming the high-pressure oil storage chamber.

According to another aspect of the invention, a partition wall forming a side wall of the high-pressure oil storage chamber at a side thereof that faces the compression mechanism unit is provided so as to form a space between the compression mechanism unit and the high-pressure oil storage chamber within the housing, and a portion of an oil return passage through which the oil stored in the high-pressure oil storage chamber is fed back to the compression mechanism unit is constructed as an oil feed pipe which is disposed outside the housing.

According to another aspect of the invention, the oil feed pipe is provided with a bent portion so as not to connect between the high-pressure oil storage chamber and the compression mechanism unit by the shortest distance.

According to another aspect of the invention, the partition wall is joined to the housing on an interior side thereof.

According to another aspect of the invention, the partition wall has a cross-sectional shape curved inwardly into the high-pressure oil storage chamber.

According to another aspect of the invention, an end portion of the compression mechanism unit is located inside the curved portion of the partition wall.

According to another aspect of the invention, the partition wall is joined to the outer wall of the high-pressure oil storage chamber on an interior side thereof.

According to another aspect of the invention, the outer wall of the high-pressure oil storage chamber is formed so that an outer edge thereof can be fitted tightly into an inner circumferential edge of the housing at one axial end thereof, and the one end of the housing and an outer circumferential portion near the outer edge of the outer wall thus fitted are welded together, while on the other hand, the partition wall is fitted in close contact with an inner circumferential surface of the outer edge of the outer wall, and a peripheral edge of the partition wall is welded around a periphery thereof where the partition wall is held in close contact with the inner circumferential surface of the outer edge of the outer wall.

According to another aspect of the invention, the compression mechanism unit is of a scroll type.

According to another aspect of the invention, carbon dioxide is used as the refrigerant.

According to another aspect of the invention, the exit hole is provided with a filter for removing foreign matter from the oil.

According to another aspect of the invention, one end of the oil feed pipe protrudes into the high-pressure oil storage chamber from a bottom surface thereof.

According to another aspect of the invention, a filter is provided at a position downstream of the oil feed pipe and upstream of the constricted portion.

According to another aspect of the invention, the oil feed pipe has an inner diameter larger than the diameter of the reduced portion of the oil return passage.

According to another aspect of the invention, the compression mechanism unit and the oil separator are connected in a communicating fashion by a discharge pipe installed passing through the compression mechanism unit, and an outer circumference of the discharge pipe is separated from the compression mechanism unit by a heat insulating material.

BEST MODE FOR CARRYING OUT THE INVENTION

Embodiment 1

Figure 1:
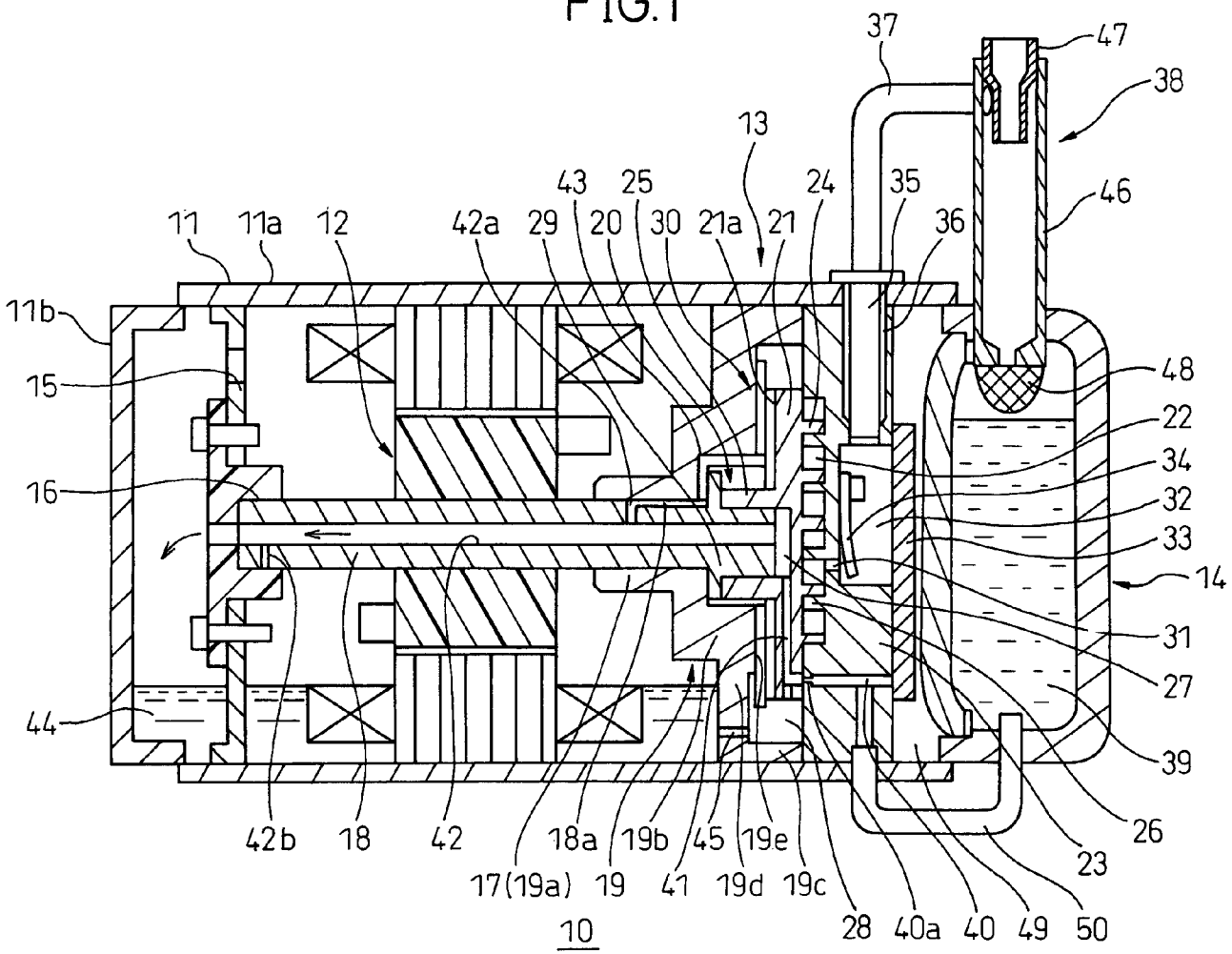
FIG. 1 is an explanatory cross-sectional view showing a first embodiment of a compressor according to the present invention.

FIG. 1 shows a scroll-type compressor 10 constructed by housing a motor unit 12 and a compression mechanism unit 13 in a sealed container 11. The compressor 10 compresses refrigerant brought in from an external refrigerant circuit, separates oil from the compressed refrigerant, and returns the refrigerant to the external refrigerant circuit; i.e., during the operation, oil is constantly supplied to and recovered from the component members of moving parts in the compression mechanism unit 13, etc.

Compressor 10 uses carbon dioxide ($CO_2$) as the refrigerant. Compared with traditional CFC refrigerants, carbon dioxide refrigerant requires a higher pressure for operation, and an extremely large pressing force is applied to the portion where the orbiting scroll meshes with the fixed scroll, but since the compressor is constructed to constantly supply and recover oil during the operation, as will be described later, carbon dioxide can be used as the refrigerant.

The overall construction of the compressor 10 will be described below.

The sealed container 11 of the compressor 10 comprises a cylindrically shaped housing 11*a* and a pressure-resistant container 14 as a high-pressure oil storage chamber (to be described later) for storing oil to be recirculated, the container 14 being integrally joined to the housing 11*a* to form a sealed structure.

The compressor 10 is constructed so that a shaft 18 supported in a substantially horizontal position by a main bearing 17 and a sub-bearing 16 supported on a supporting member 15 within the housing 11*a* is rotated by the motor unit 12 to operate the compression mechanism unit 13 hereinafter described.

The compression mechanism unit 13 comprises a middle housing 19 fixed within the housing 11*a*, a moving scroll 21 which revolves in an orbiting fashion by the action of a crank mechanism 20 supported on the main bearing 17 provided in the middle housing 19, and a fixed scroll 21 disposed opposite the moving scroll 21 and working together to define therebetween compression chambers 22 to be described later.

The moving scroll 21 is substantially disc-shaped, and comprises a moving-side scroll member 24 formed in an involute curve-like shape and protruding toward the fixed scroll 23, and a boss 25 formed in a cylindrical shape and protruding toward the middle housing 19 from an end face facing away from the moving-side scroll member 24.

The fixed scroll 23 comprises a fixed-side scroll member 26 constructed with a spiral groove formed in an end face facing the moving scroll 21.

The middle housing 19 has a three-stage cylindrical shape whose diameter progressively increases in three stages from the side facing the motor unit 12 toward the side facing the fixed scroll 23, and the smallest diameter cylinder 19*a* nearest to the motor unit 12 forms the main bearing 17, while the middle cylinder 19*b* forms a crank chamber 27 for accommodating the crank mechanism 20, and the largest diameter cylinder 19*c* nearest to the fixed scroll 23 forms a scroll accommodating portion 28 for accommodating the moving scroll 21 and is fastened to the inner circumferential surface of the housing 11*a* by a fastening means such as shrink fitting.

The crank mechanism 20 comprises an eccentric 29 formed integrally with the shaft 18 at an end thereof connected to the compression mechanism unit 13, and the boss 25 of the moving scroll 21. The eccentric 29 is mounted with its axis of rotation displaced by a prescribed amount relative to the center axis of the main bearing 17 and sub-bearing 16. This amount of eccentricity defines the orbiting radius of the moving scroll 21.

An Oldham coupling not shown is disposed on the moving scroll 21 side end face of a disc portion 19*d* connecting between the large-diameter cylinder 19*c* and middle cylinder 19*b* forming the middle housing 19 (the end face is hereinafter called the scroll side disc end face 19*e*), to prevent the moving scroll 21 from rotating on its axis. Thus, the moving scroll 21 is allowed to revolve only in an orbiting fashion.

A thrust bearing 30 as a slide bearing which allows the boss 25 side end face of the moving scroll 21 (hereinafter called the moving scroll rear face 21*a*) to slide against the scroll side disc end face 19*e* is provided between the moving scroll rear face 21*a* and the scroll side disc end face 19*e*.

In the thus constructed compression mechanism unit 13, the plurality of compression chambers 22 formed by the moving-side scroll member 24 meshing with the fixed-side scroll member 26 are reduced in volume as the moving scroll 21 revolves relative to the fixed scroll 23, and the compressor thus accomplishes the function of compressing the refrigerant drawn into a suction chamber (not shown) communicating with the radially outermost portion of the fixed-side scroll member 26.

Further, in the compression mechanism unit 13, a discharge port 31 passing through the fixed scroll 23 along the axial direction thereof is provided in the center portion of the fixed-side scroll member 26. The refrigerant compressed by the action of the moving scroll 21 and fixed scroll 23 is discharged through the discharge port 31 into a discharge chamber 32.

The discharge chamber 32 is formed by hermetically sealing with a shielding wall 33 the space formed in the center portion of the side face of the fixed scroll 23 opposite to the side face where the fixed-side scroll member 26 is formed.

The discharge chamber 32 is provided with a discharge valve 34 for preventing backflow of the discharged refrigerant by closing the discharge port 31 formed through the fixed scroll 23 in the axial direction thereof.

Further, a discharge pipe 35 communicating with the exterior of the housing 11*a* is formed passing through the portion of the fixed scroll 23 located above the discharge chamber 32. A space 36 is provided around the outer circumference of the discharge pipe 35. The discharge pipe 35 is connected with part of an oil separator 38 outside of the housing 11*a* via a connecting pipe 37. Instead of the space 36, a known heat insulating material (not shown) may be provided around the outer circumference of the discharge pipe 35.

Next, the configuration of the oil circulating mechanism in the thus constructed compressor 10 will be described. As the moving parts of the compression mechanism unit 13 operate, oil is supplied from the pressure-resistant container 14, which forms the high-pressure oil storage chamber to be described later, to the compression mechanism unit 13 in the housing 11*a* held at a relatively low pressure.

For this purpose, an oil return passage 40 is formed as an oil passage passing through the portion of the fixed scroll 23 located below the discharge chamber 32.

A small-diameter constricted portion 40*a* leading to an oil passage 41 is formed on the outlet side of the oil return passage 40 that faces the moving scroll 21. An inlet to the oil passage 41 is intermittently connected with the outlet of the oil return passage 40 as the moving scroll 21 revolves. On the other hand, the outlet of the oil passage 41 is opened in an inside wall of the boss 25 so as to communicate with the space formed between the end of the shaft 18 and the crank chamber 27 at the bottom of the boss 25.

The oil from the oil return passage 40 is a high-pressure oil, but is reduced to a desired pressure as it passes through the constricted portion 40*a* and as the oil return passage 40 is intermittently connected with the oil passage 41 by the revolution of the moving scroll 21.

The crank chamber 27 formed between the end of the shaft 18 and the bottom of the boss 25 communicates with an oil passage 42 which extends through the shaft 18 along the axial direction thereof.

The oil passage 42 is provided with radially outwardly extending holes 42*a* and 42*b* at positions corresponding to the main bearing 17 and the sub-bearing 16, respectively, in such a manner as to branch from the oil passage 42.

The outlet of the radially outwardly extending hole 42*a* communicates with a shaft groove 18*a* formed in the shaft 18.

To feed the oil to the thrust bearing 30 above the shaft 18, an oil groove 43 communicating between the radially outwardly extending hole 42*a* and the thrust bearing 30 is formed in the portion of the middle cylinder 19*b* above the shaft 18.

The entire bottom portion of the sealed container 11 forms a low-pressure oil storage chamber 44 in which the oil passed through the oil passage 42 is stored.

An oil return hole 45 is formed below the disc portion 19*d* of the middle housing 19 so that the oil stored in the low-pressure oil storage chamber 44 can be returned to the scroll accommodating portion 28.

The oil separator 38, which receives the compressed refrigerant via the connecting pipe 37 from the upwardly extending discharge pipe 35 formed through the fixed scroll 23 of the compression mechanism unit 13 in the housing 11*a*, is a centrifugal oil separator and has a separation cylinder 46.

The connecting pipe 37 through which the refrigerant discharged from the compression mechanism unit 13 is introduced tangentially into the separation cylinder 46 is connected to the upper portion of the separation cylinder 46.

A separation pipe 47 for delivering the refrigerant to the external refrigerant circuit (not shown) after removing the oil is fitted into the upper portion of the separation cylinder 46. The outer diameter of the upper half portion of the separation pipe 47 is approximately equal to the inner diameter of the separation cylinder 46, and the outer diameter of the lower half portion is approximately one half of the inner diameter of the separation cylinder 46; the connecting pipe 37 is connected at the position facing the outer circumference of the lower half portion so that the refrigerant is introduced tangentially along the inner wall of the separation cylinder 46.

Utilizing the feature of carbon dioxide that its volume flow rate is small, the outer diameter of the oil separator 38 is held so as not to exceed twice that of an external pipe not shown, thereby achieving a construction that is not disadvantageous in terms of size.

The lower end of the separation cylinder 46 is positioned inside the high-pressure oil storage chamber 39 contained in the housing 11*a*, and is provided with an exit hole communicating with the high-pressure oil storage chamber 39; a filter 48 for removing foreign matter is installed in the exit hole.

The high-pressure oil storage chamber 39 is formed by an axial end wall of the housing 11*a* and a second housing that is located inside one side face and that forms the pressure-resistant container 14 in combination with the one side face. Here, the wall of the pressure-resistant container 14 is thicker than the wall forming the housing 11*a*, and the cross-sectional shape of the inner wall is substantially elliptical in shape in order to increase the strength.

A space 49 in which oil is not filled is defined within the housing 11*a* between the second housing forming the pressure-resistant container 14 and the shielding wall 33 forming the discharge chamber 32 in the compression mechanism unit 13. That is, since the space 49 is formed within the housing 11*a* by being enclosed by the second housing forming the pressure-resistant container 14, the fixed scroll 23, and the shielding wall 33 forming the discharge chamber 32 in the compression mechanism unit 13, the oil in the high-pressure oil storage chamber 39 does not flow into this space.

An oil feed pipe 50 for feeding the oil stored in the high-pressure oil storage chamber 39 back to the compression mechanism unit 13 is connected to the bottom of the high-pressure oil storage chamber 39.

The oil feed pipe 50 is connected so as to communicate with the oil return passage 40 formed passing through the fixed scroll 23.

Next, the operation and working of the compressor 10 according to the present invention will be described.

When the motor unit 12 of the compressor 10 is turned on to operate the compression mechanism unit 13, the refrigerant from the refrigerant circuit is drawn into the suction chamber (not shown) communicating with the radially outermost portion of the fixed-side scroll member 26.

As the shaft 18 of the motor unit 12 rotates causing the moving scroll 21 to revolve relative to the fixed scroll 23, the plurality of compression chambers 22 formed by the moving-side scroll member 24 meshing with the fixed-side scroll member 26 are reduced in volume, thus compressing the refrigerant drawn into the suction chamber (not shown) communicating with the radially outermost portion of the fixed-side scroll member 26.

In this case, the oil used to lubricate the moving parts in the compression mechanism unit 13 is contained in the form of a mist in the refrigerant which is put in a high-pressure, high-temperature condition. Further, as a result of the above operation, the compression mechanism unit 13 is put in a high-temperature condition.

The refrigerant compressed by the action of the moving scroll 21 and fixed scroll 23 is discharged through the discharge port 31 formed passing through the fixed scroll 23 in the axial direction thereof, and fed into the discharge chamber 32 via the discharge valve 34.

Then, from the discharge chamber 32, the refrigerant passes through the discharge pipe 35 formed passing through the housing 11*a*, and is introduced into the oil separator 38 through the connecting pipe 37.

Since the outer circumference of the discharge pipe 35 is separated from the fixed scroll 23 by the space 36, if the fixed scroll 23 is heated to a high temperature due to the operation of the compression mechanism unit 13, the thermal effects that may affect the refrigerant passing through the discharge pipe 35 can be suppressed.

Figure 2:
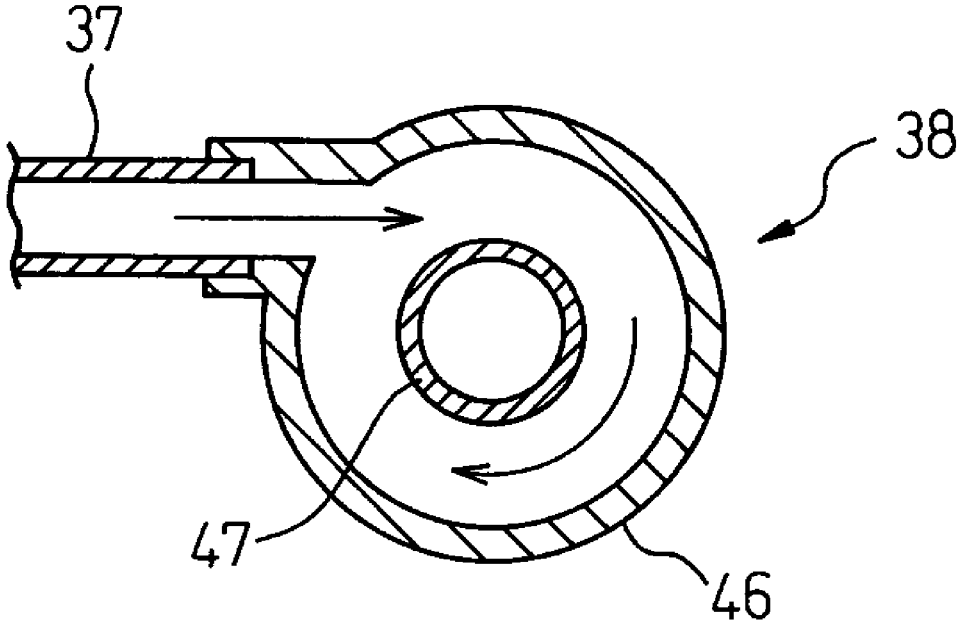
FIG. 2 is a schematic view explaining the function of a separation cylinder in an oil separator of the compressor.

The refrigerant, when introduced through the connecting pipe 37 into the separation cylinder 46, flows tangentially along the inner wall of the separation cylinder 46, the flow of the refrigerant forming a whirling stream due to the presence of the separation pipe 47 in the upper part of the separation cylinder 46 (see FIG. 2).

As the refrigerant flows along the inner wall of the separation cylinder 46, the oil contained in the refrigerant is separated by centrifugal force, and the refrigerant from which the oil has been separated is delivered to the external refrigerant circuit (not shown), while on the other hand, the separated oil flows downward along the inner wall of the separation cylinder 46 and passes through the filter 48 at the lower end of the separation cylinder 46, where foreign matter is removed from the oil, and thus the oil can be stored in the pressure-resistant container 14 in the high-pressure oil storage chamber 39.

Accordingly, the stored oil is free from foreign matter, and the oil returned to the compression mechanism unit 13 does not cause any problem to the compression mechanism unit 13.

Since the lower end of the separation cylinder 46 of the oil separator 38 is positioned inside the high-pressure oil storage chamber 39 in the housing 11*a*, there is no need to provide a pipe connecting between the lower end of the separation cylinder 46 and the high-pressure oil storage chamber 39, and the production cost can be reduced accordingly.

The high-pressure oil storage chamber 39 is in a high-pressure condition because of the operation of the compression mechanism unit 13, and the oil is in a high-temperature condition. If the high-pressure oil storage chamber 39 is put in a high-pressure condition, the high-pressure oil storage chamber 39 is strong enough to withstand the high pressure because the wall of the pressure-resistant container 14 is thicker than the wall forming the housing 11*a* and the cross-sectional shape of the inner wall is substantially elliptical in shape. Further, since the high-pressure oil storage chamber 39 is constructed using the outer wall of the pressure-resistant container 14 which forms one end wall of the housing 11*a*, the storage capacity of the high-pressure oil storage chamber 39 is large enough to store a sufficient amount of lubricating oil.

Moreover, since the space 49 in which oil is not filled is formed within the housing 11*a* between the pressure-resistant container 14 and the shielding wall 33 forming the discharge chamber 32 in the compression mechanism unit 13, heat conduction is suppressed, and the effects of the temperature rise of the compression mechanism unit 13 during operation can be minimized.

The oil stored in the high-pressure oil storage chamber 39 is fed back to the compression mechanism unit 13 via the oil feed pipe 50 connected to the bottom of the high-pressure oil storage chamber 39 and via the oil return passage 40 formed passing through the fixed scroll 23.

When the oil passes through the oil return passage 40 and enters the constricted portion 40*a* at the moving scroll 21 side outlet thereof leading to the oil passage 41, the inlet to the oil passage 41 is intermittently connected with the outlet of the oil return passage 40 as the moving scroll 21 revolves, and the oil is thus reduced to the desired pressure and fed through the oil passage 41 into the space formed between the end of the shaft 18 and the crank chamber 27 at the bottom of the boss 25.

Then, from the crank chamber 27 formed between the end of the shaft 18 and the bottom of the boss 25, the oil is fed into the oil passage 42 formed passing through the shaft 18 along the axial direction thereof, and the oil introduced through the radially outwardly extending holes 42*a* and 42*b* formed at positions corresponding to the main bearing 17 and the sub-bearing 16, respectively, lubricates the main bearing 17 and the sub-bearing 16.

The oil is further introduced into the shaft groove 18*a* at the outlet of the radially outwardly extending hole 42*a*, and then into the oil groove 43 communicating between the radially outwardly extending hole 42*a* and the thrust bearing 30; in this way, the oil can be introduced into the thrust bearing 30.

The oil thus passed through the oil passage 42 is stored in the low-pressure oil storage chamber 44 formed so as to cover the entire bottom portion of the sealed container 11.

The oil stored in the low-pressure oil storage chamber 44 can then be fed back to the scroll accommodating portion 28 through the oil return hole 45 formed below the disc portion 19*d* of the middle housing 19.

The oil returned to the scroll accommodating portion 28 is supplied to the sliding faces of the moving scroll 21 and fixed scroll 23, where it is compressed in the compression chambers 22 together with the refrigerant, and the oil is again separated from the refrigerant in the oil separator; the separated oil can then be stored in the pressure-resistant container 14 in the high-pressure oil storage chamber 39.

As described above, the compressor 10 operates to not only compress but also circulate the oil, and since the space 49 in which oil is not filled is formed within the housing 11*a* between the pressure-resistant container 14 forming the high-pressure oil storage chamber 39 and the shielding wall 33 forming the discharge chamber 32 in the compression mechanism unit 13, the compression mechanism unit 13 can be thermally insulated from the pressure-resistant container 14.

Accordingly, even when carbon dioxide whose performance as a refrigerant is easily affected by heat is used as the refrigerant, the temperature rise in the high-pressure oil storage chamber 39 does not cause degradation of the performance.

Further, in the compressor 10, since one axial end wall of the housing 11*a* is used as the outer wall of the pressure-resistant container 14 forming the high-pressure oil storage chamber 39 located adjacent to the compression mechanism unit 13 within the housing 11*a*, and since this axial end wall is thicker than the other outer walls forming the housing 11*a*, and the cross-sectional shape of the inner wall is substantially elliptical in shape, it has sufficient strength to withstand the high pressure of the high-pressure oil storage chamber 39. Furthermore, since the entire end wall of the housing 11*a* is used as the outer wall of the high-pressure oil storage chamber 39, the storage capacity of the high-pressure oil storage chamber 39 is large enough to store a sufficient amount of lubricating oil.

Further, since the outer circumference of the discharge pipe 35 is separated from the fixed scroll 23 by the space 36, if the fixed scroll 23 is heated to a high temperature due to the operation of the compression mechanism unit 13, the thermal effects that may affect the refrigerant passing through the discharge pipe 35 can be suppressed.

Moreover, in the present embodiment, since the oil stored in the high-pressure oil storage chamber 39 is returned to the compression mechanism unit 13 by passing it through the oil feed pipe 50 installed outside the container and connected to the bottom of the high-pressure oil storage chamber 39 and then through the oil return passage 40, the thermal effects due to the returned oil can be suppressed, and the connecting portion can be prevented from deforming under the high pressure of the high-pressure oil storage chamber and causing oil leakage.

Embodiment 2

Figure 3:
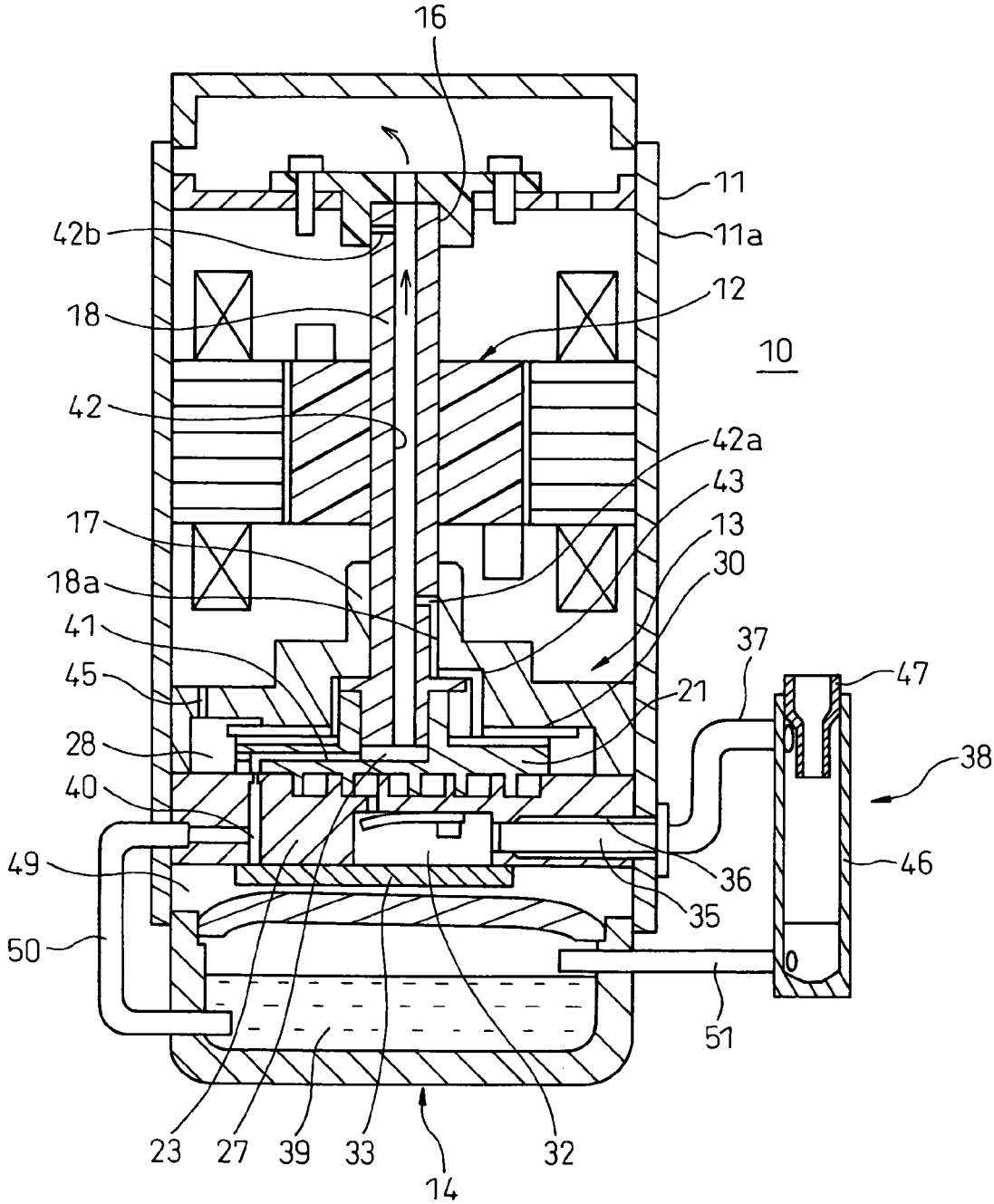
FIG. 3 is an explanatory cross-sectional view showing a second embodiment of a compressor according to the present invention.

The compressor 10 according to the present invention can also be constructed as shown in FIG. 3.

The compression mechanism unit 13 of this compressor 10 is identical in construction to that of the compressor 10 of the first embodiment, and the description thereof will not be repeated here.

The compressor 10 of this embodiment is designed to be installed differently from the first embodiment. That is, the compressor 10 is installed so that the shaft 18 of the motor unit 12 that drives the compression mechanism unit 13 within the housing 11*a* is oriented in a vertical direction.

Accordingly, in this case, as in the case of the pressure-resistant container 14 in the compressor 10 of the first embodiment, the wall of the pressure-resistant container 14 forming the high-pressure oil storage chamber 39 is made thicker than that of the housing 11*a*, and the outside wall forms the end wall of the housing 11*a* and closes the bottom of the housing 11*a*.

In this embodiment also, the space 49 is formed between the inside wall of the pressure-resistant container 14 and the shielding wall 33 forming the discharge chamber 32 in the compression mechanism unit 13.

In the compressor 10 of this embodiment, the separation cylinder 46 forming the oil separator 38 is completely separated from the housing 11*a* and installed in a vertical position as shown, and the separation pipe 47 for promoting the separation of oil from the introduced refrigerant is fitted into the upper end portion of the separation cylinder 46.

On the other hand, the lower end portion of the separation cylinder 46 is connected via an oil recovery pipe 51 to the upper portion of one side of the pressure-resistant container 14 so as to communicate with the interior of the high-pressure oil storage chamber 39.

In this compressor 10 also, the discharge pipe 35 communicating between the discharge chamber 32 and the exterior of the housing 11*a* is installed passing through the space 36 and joined to the connecting pipe 37.

According to the thus constructed compressor 10, like the compressor 10 of the first embodiment, since the space 49 in which oil is not filled is formed within the housing 11*a* between the pressure-resistant container 14 forming the high-pressure oil storage chamber 39 and the shielding wall 33 forming the discharge chamber 32 in the compression mechanism unit 13, the compression mechanism unit 13 can be thermally insulated from the pressure-resistant container 14, and if the temperature in the high-pressure oil storage chamber 39 rises, the performance does not drop because the refrigerant introduced into the compression mechanism unit 13 can be prevented from being heated.

Furthermore, as in the pressure-resistant container 14 of the first embodiment, since the wall is thicker than that of the housing 11*a*, and since the outside wall forms the end wall of the housing 11*a* and closes the end of the housing 11*a*, the structure can provide the necessary strength.

Embodiment 3

Figure 4:
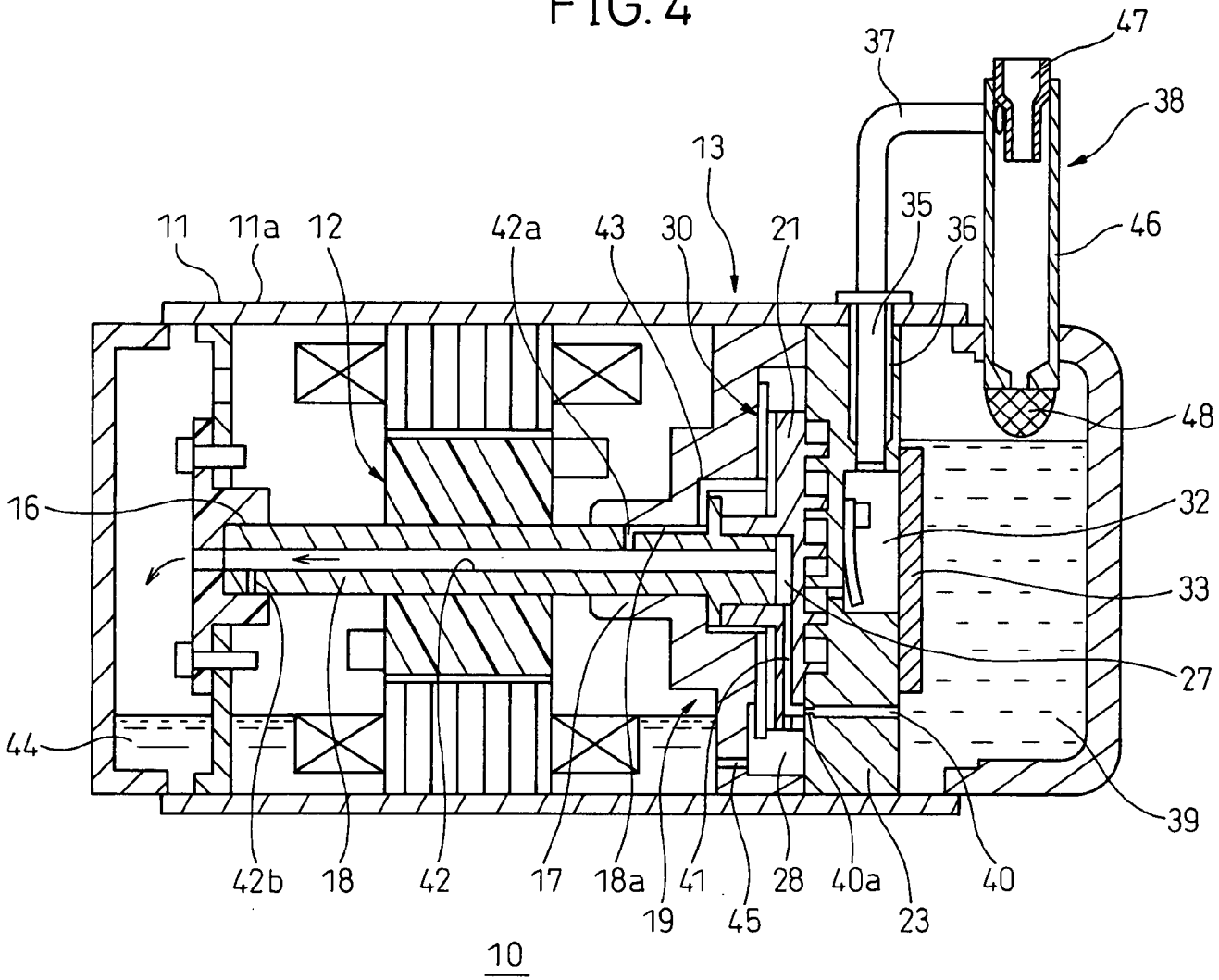
FIG. 4 is an explanatory cross-sectional view showing a third embodiment of a compressor according to the present invention.

The compressor 10 according to the present invention can also be constructed as shown in FIG. 4.

In this compressor 10, like the compressor 10 of the first embodiment, the high-pressure oil storage chamber 39 is located adjacent to the compression mechanism unit 13, and forms one end portion of the housing 11*a*.

However, unlike the high-pressure oil storage chamber 39 in the compressor 10 of the first embodiment, the high-pressure oil storage chamber 39 of this embodiment is not constructed as an independent pressure-resistant container 14, but one end wall of the housing 11*a* is formed thicker than the other outer walls of the housing 11*a* and used as the outer wall of the high-pressure oil storage chamber 39.

Further, in this embodiment, the fixed scroll 23 in the compression mechanism unit 13 and the shielding wall 33 forming the discharge chamber 32 in the fixed scroll 23 are made to serve as a partition separating the high-pressure oil storage chamber 39, to further enlarge the capacity of the high-pressure oil storage chamber 39.

In this embodiment also, the space 36 is provided around the outer circumference of the discharge pipe 35 communicating between the discharge chamber 32 and the exterior of the housing 11*a*.

Embodiment 4

Figure 5:
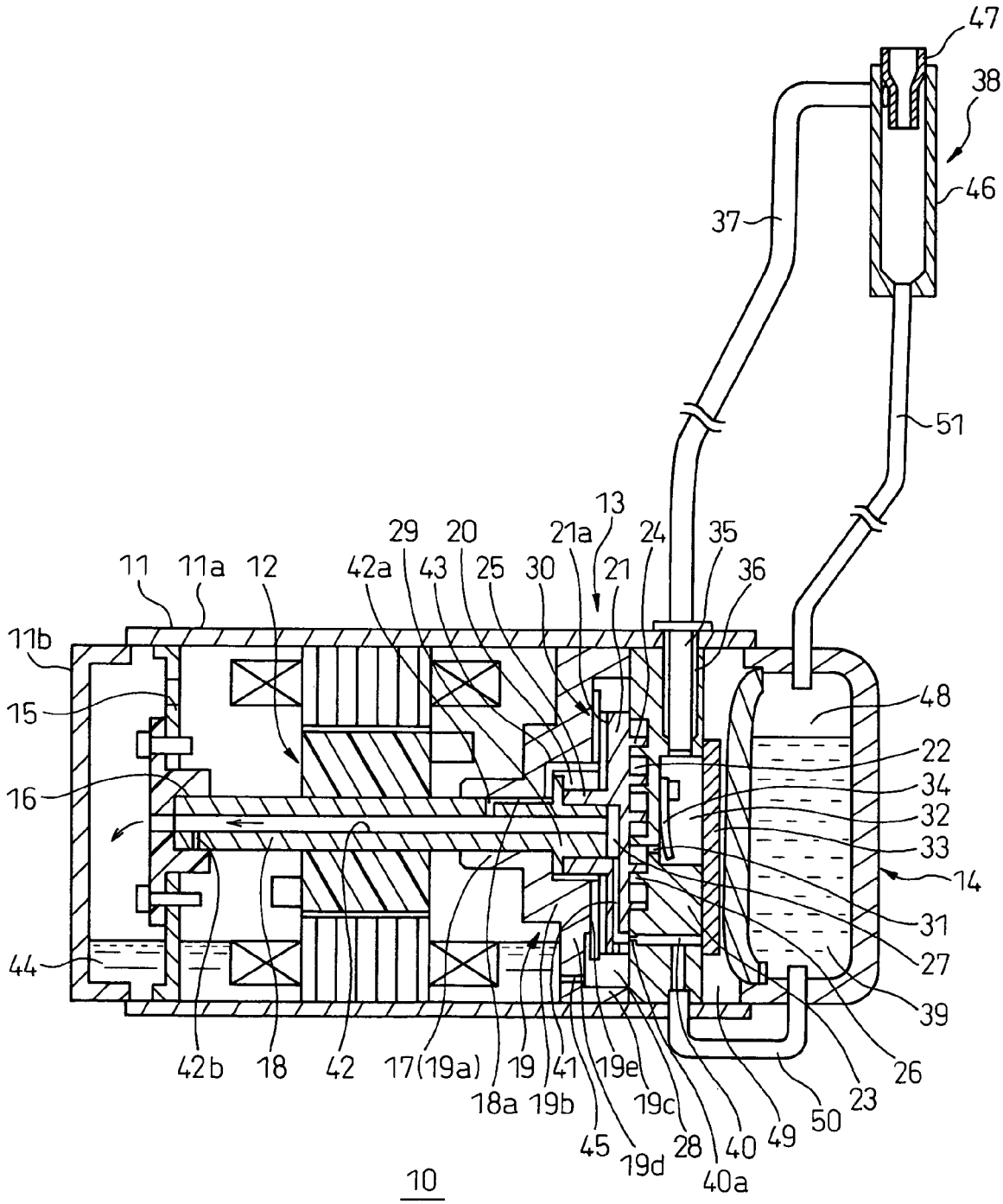
FIG. 5 is an explanatory cross-sectional view showing a fourth embodiment of a compressor according to the present invention.

The compressor 10 according to the present invention can also be constructed as shown in FIG. 5.

In this compressor 10, the separation cylinder 46 forming the oil separator 38 is separated from the housing 11*a* so that it can be installed at a suitable position to match the vehicle body where the compressor is mounted. The compression mechanism unit 13 is identical in construction to that of the compressor 10 of the first embodiment, and the description thereof will not be repeated here.

In this embodiment, the refrigerant discharged from the compression mechanism unit 13 is passed through the discharge pipe 35 formed passing through the fixed scroll 23 of the compression mechanism unit 13 to communicate with the exterior thereof, and is introduced tangentially into the separation cylinder 46 of the oil separator 38 through a long connecting pipe 37 connected to the upper portion of the separation cylinder 46.

A separation pipe 47 for delivering the refrigerant to the external refrigerant circuit (not shown) after removing the oil is fitted into the upper portion of the separation cylinder 46. This separation pipe 47 is identical in construction to the separation pipe 47 of the first embodiment.

The outer diameter of the upper half portion of the separation pipe 47 is approximately equal to the inner diameter of the separation cylinder 46, and the outer diameter of the lower half portion is approximately one half of the inner diameter of the separation cylinder 46; the connecting pipe 37 is connected at the position facing the outer circumference of the lower half portion so that the refrigerant is introduced tangentially along the inner wall of the separation cylinder 46.

The lower end of the separation cylinder 46 is connected via an oil recovery pipe 51 to the upper portion of the pressure-resistant container 14 so as to communicate with the interior of the high-pressure oil storage chamber 39 located inside the housing 11*a*.

In this way, since the separation cylinder 46 forming the oil separator 38 can be installed away from the housing 11*a*, the compressor 10 according to the present invention can be readily adapted to match the mounting space in the vehicle body, enhancing the versatility of the compressor 10.

Embodiment 5

Figure 6:
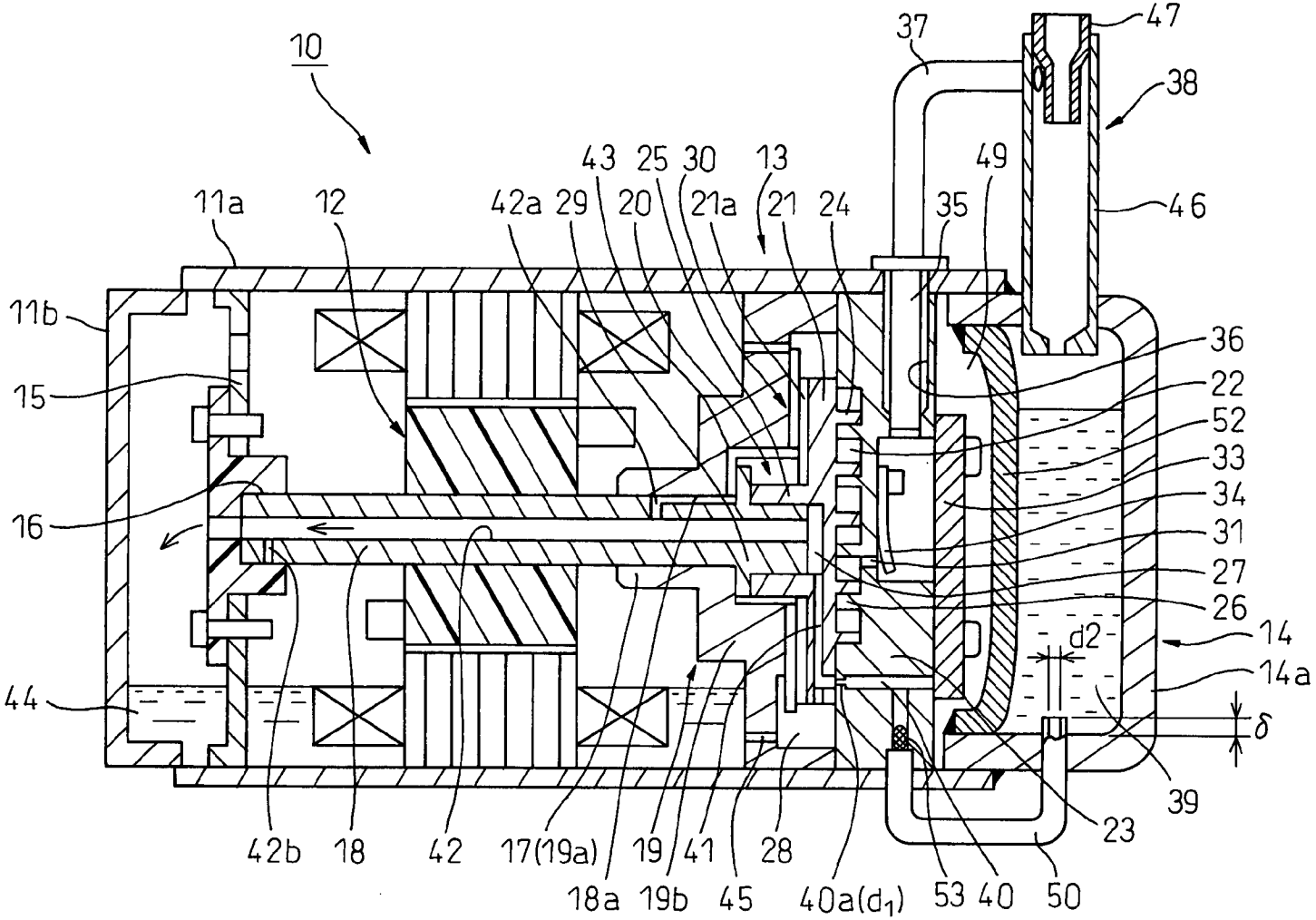
FIG. 6 is an explanatory cross-sectional view showing a fifth embodiment of a compressor according to the present invention.

The compressor 10 according to the present invention can also be constructed as shown in FIG. 6.

In this embodiment, one end wall of the housing 11*a* is formed thicker than the other outer walls of the housing 11*a*, and this end wall is used as the outer wall 14*a* of the high-pressure oil storage chamber 39.

More specifically, the high-pressure oil storage chamber 39 is constructed as a pressure-resistant container 14 comprising the thick end wall 14*a* and a partition wall 52 that partitions the interior of the housing 11*a* at the position where the end wall 14*a* is joined to the other outer walls of the housing 11*a*.

The space 49 in which oil is not filled is formed between this partition wall 52 and the shielding wall 33 forming the discharge chamber 32 in the compression mechanism unit 13.

The construction of the high-pressure oil storage chamber 39 will be described in detail below in relation to the housing 11*a*.

The pressure-resistant container 14 forming the high-pressure oil storage chamber 39 has a greater wall thickness than the housing 11*a*, and the cross-sectional shape of the inner wall is substantially elliptical in shape in order to increase the strength.

The container's outer wall 14*a* is formed in the shape of a bowl so that its outer edge can be fitted tightly into the inner circumferential edge of the housing 11*a* at one axial end thereof, and the one end of the housing 11*a* and the outer circumferential portion near the outer edge of the container's outer wall 14*a* thus fitted are welded together.

On the other hand, the partition wall 52 is sized so that it can be fitted in close contact with the inner circumferential surface of the outer edge of the container's outer wall 14*a*.

In this case, the partition wall 52 has a vertically erected shape so that its peripheral edge can be fitted in intimate contact with the inner circumferential surface of the outer edge of the container's outer wall 14*a*, and the peripheral edge is welded at the portion where it intimately contacts the inner circumferential surface of the outer edge of the container's outer wall 14*a*.

The partition wall 52 has a curved shape such that its surface from the peripheral edge welded portion to the center of the wall is gradually curved inwardly toward the high-pressure oil storage chamber 39 in a direction away from the compression mechanism unit 13.

Next, the configuration of the oil circulating mechanism according to the present embodiment will be described. In the present embodiment, as the moving parts of the compression mechanism unit 13 operate, oil is supplied from the high-pressure oil storage chamber 39 to the compression mechanism unit 13 in the housing 11*a* held at a relatively low pressure; for this purpose, the oil feed pipe 50 installed at the bottom of the high-pressure oil storage chamber 39 is connected so as to communicate with the oil return passage 40 formed in the fixed scroll 23. A small-diameter constricted portion 40*a* leading to an oil passage 41 is formed on the outlet side of the oil return passage 40 that faces the moving scroll 21. An inlet to the oil passage 41 is intermittently connected with the outlet of the oil return passage 40 as the moving scroll 21 revolves. The oil is reduced to a desired pressure as it passes through the constricted portion 40*a* and as the oil return passage 40 is intermittently connected with the oil passage 41 by the revolution of the moving scroll 21.

The oil feed pipe 50 is installed outside the housing 11*a*, and its one end is connected to the bottom of the high-pressure oil storage chamber 39, while the other end is connected to the oil return passage 40. The one end of the oil feed pipe 50 is inserted in the bottom so that the end protrudes from the bottom surface of the high-pressure oil storage chamber 39 by a protrusion amount 6. This prevents foreign matter accumulated on the bottom surface of the high-pressure oil storage chamber 39 from being drawn directly into the oil feed pipe 50.

The inner diameter d2 of the oil feed pipe 50 is larger than the diameter d1 of the small-diameter constricted portion 40*a* formed at the moving scroll 21 side outlet. This serves to prevent the relatively long oil feed pipe 50 from becoming clogged with foreign matter contained in the oil. Further, a filter 53 is installed on the downstream side of the oil feed pipe 50 at a position leading to the oil return passage 40 in the fixed scroll 23, thus preventing foreign matter from flowing into the small-diameter constricted portion 40*a*.

During the operation of the thus constructed compressor 10, the high-temperature oil is temporarily stored in the high-pressure oil storage chamber 39.

The high-pressure oil storage chamber 39 is in a high-pressure condition because of the operation of the compression mechanism unit 13, and the oil is in a high-temperature condition.

Figure 7:
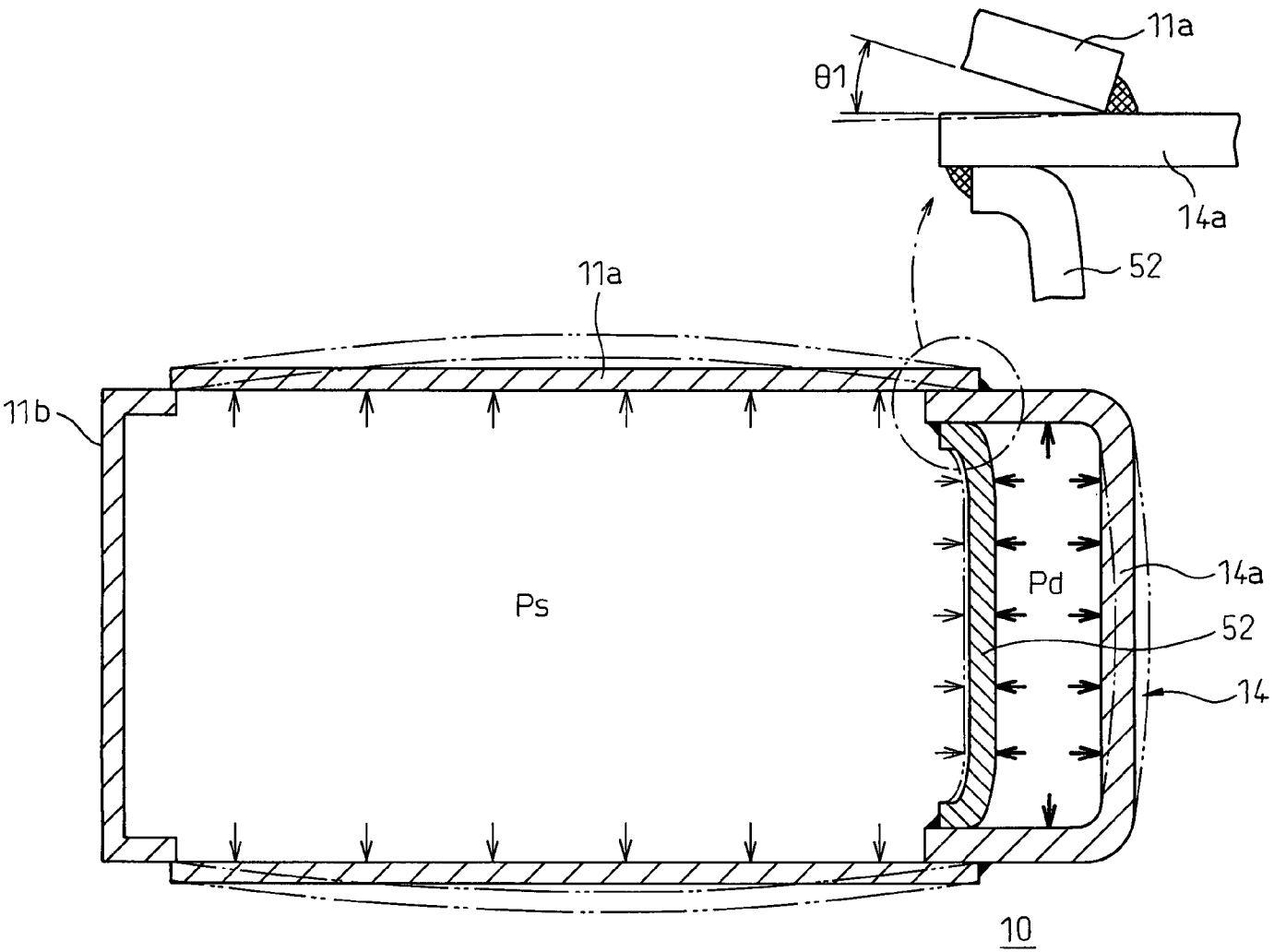
FIG. 7 is an explanatory cross-sectional view explaining the operation of the compressor shown in FIG. 6.

When the high-pressure oil storage chamber 39 is in a high-pressure condition, since the pressure-resistant container 14 forming the high-pressure oil storage chamber 39 comprises the partition wall 52 and the thick outer wall 14*a* that forms the one axial end wall of the housing 11*a*, and since the cross-sectional shape of the inner wall is substantially elliptical in shape, an internal pressure Pd is applied to the entire structure of the pressure-resistant container 14 as shown by arrows in FIG. 7.

At this time, the housing 11*a* accommodating the compression mechanism unit 13 is also subjected to an internal pressure Ps (Pd>Ps).

As a result, the pressure-resistant container 14 and the housing 11*a* deform outwardly, as shown by two-dot dashed lines, due to the respective internal pressures Pd and Ps.

However, in this compressor 10, since the periphery at the one end of the housing 11*a* and the outer circumference near the outer edge of the container's outer wall 14*a* are welded together, and the outer edge of the container's outer wall 14*a* and the peripheral edge of the partition wall 52 are also welded together, the welded portions thus being close to each other, the deformations caused by the high pressures can be suppressed.

Moreover, since the partition wall 52 partitioning the housing 11*a* between the high-pressure oil storage chamber 39 and the compression mechanism unit 13 is separated by the space 49 from the shielding wall 33 forming the discharge chamber 32 in the compression mechanism unit 13, and since the surface of the partition wall from the peripheral edge welded portion to the center of the wall is gradually curved inwardly into the high-pressure oil storage chamber 39, the deformation due to the internal pressure Pd can be suppressed.

If the partition wall 52 is deformed due to the internal pressure Pd, the space 49 serves as a buffer in the housing 11*a* accommodating the compression mechanism unit 13, and the partition wall does not come into contact with the fixed scroll as would be the case with the prior art; in this way, the effects of the high pressure on the compression mechanism unit 13 can be effectively avoided.

As shown in the enlarged view of the welded portions, since the stress is most concentrated at the portion about which the housing 11*a* turns with respect to the container's outer wall 14*a*, it is important that the angle of turn θ1 be minimized from the standpoint of maintaining the strength of the welded portions. Further, when the partition wall 52 tries to deform toward the compression mechanism unit 13 due to the pressure, the peripheral portion of the partition wall 52 tries to expand outwardly at the portion where it is welded to the container's outer wall 14*a*, but since the outer circumference of the partition wall 52 is restrained not only by the container's outer wall 14*a*, but also by the housing 11*a*, the outward expansion is suppressed, and as a result, the deformation of the partition wall 52 toward the compression mechanism unit 13 can also be suppressed.

The oil temporarily stored in the high-pressure oil storage chamber 39 is then transported through the oil feed pipe 50 and the oil return passage 40 and enters the small-diameter constricted portion 40*a*.

When the oil enters the constricted portion 40*a* leading to the oil passage 41, the inlet to the oil passage 41 is intermittently connected with the outlet of the oil return passage 40 as the moving scroll 21 revolves, and the oil is thus reduced to the desired pressure and fed through the oil passage 41 into the space formed between the end of the shaft 18 and the crank chamber 27 at the bottom of the boss 25; thereafter, the oil is transported along the same path as previously described in connection with the compressor 10 of the first embodiment, and supplied to lubricate the main bearing 17 and the sub-bearing 16, and the oil can be further delivered to the thrust bearing 30.

The oil thus passed through the oil passage 42 is stored in the low-pressure oil storage chamber 44. The oil stored in the low-pressure oil storage chamber 44 can then be fed back to the scroll accommodating portion 28 through the oil return hole 45 formed below the disc portion 19*d* of the middle housing 19; further, the oil is supplied to the sliding faces of the moving scroll 21 and fixed scroll 23, where it is compressed in the compression chambers 22 together with the refrigerant, and the oil is again separated from the refrigerant in the oil separator. The separated oil can then be stored in the high-pressure oil storage chamber 39.

In this embodiment also, since the outer circumference of the discharge pipe 35 is separated from the fixed scroll 23 by the space 36, if the fixed scroll 23 is heated to a high temperature due to the operation of the compression mechanism unit 13, the thermal effects that may affect the refrigerant passing through the discharge pipe 35 can be suppressed.

Furthermore, since the entire end wall of the housing 11*a* is used as the outer wall of the high-pressure oil storage chamber 39, the storage capacity of the high-pressure oil storage chamber 39 is large enough to store a sufficient amount of lubricating oil.

Moreover, the space 49 provided between the compression mechanism unit 13, especially, the shielding wall 33 covering the discharge chamber 32, and the partition wall 52 forming the high-pressure oil storage chamber 39 serves to prevent the introduced refrigerant from being heated by the heat of the high-temperature oil stored in the high-pressure oil storage chamber 39, and degradation of the compressor efficiency can thus be prevented.

In addition to the above effects, in the present embodiment, since the oil feed pipe is installed outside the container and connected to the bottom of the high-pressure oil storage chamber, the connecting portion can be prevented from deforming under the high pressure of the high-pressure oil storage chamber and causing oil leakage. Further, since one end of the oil feed pipe is connected to the bottom of the high-pressure oil storage chamber so as to protrude from the bottom, foreign matter contained in the oil and accumulated on the bottom of the high-pressure oil storage chamber can be prevented from being drawn directly into the oil feed pipe; this serves to prevent the oil return passage from becoming clogged with foreign matter. Furthermore, the inner diameter of the oil feed pipe is made larger than the diameter of the constricted portion provided at the moving scroll side outlet; this serves to further prevent the oil feed pipe from becoming clogged with foreign matter. Moreover, since the partition wall 52 is formed so as to curve inwardly into the high-pressure oil storage chamber, the shielding wall 33, etc. forming part of the pump section can be accommodated inside the partition wall 52, and thus a high-efficiency compressor that is compact and space efficient and that has a good heat insulating effect can be constructed.

Embodiment 6

Figure 8:
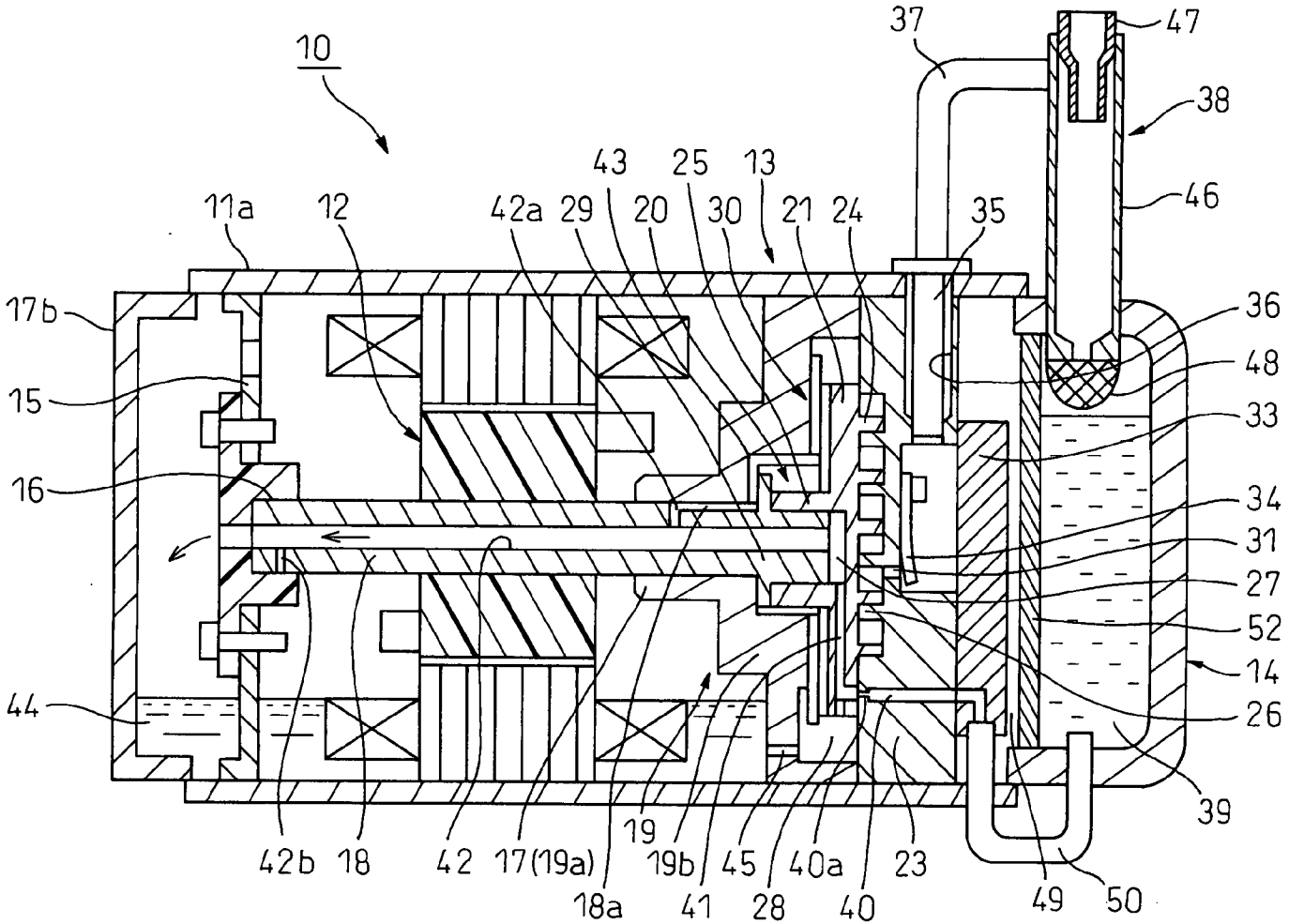
FIG. 8 is an explanatory cross-sectional view showing a sixth embodiment of a compressor according to the present invention.

FIG. 8 shows a compressor 10 according to a sixth embodiment of the present invention.

In the sixth embodiment, the oil return passage formed in the fixed scroll 23 is extended into the shielding wall 33 and connected so as to communicate with one end of the oil feed pipe 50. In the sixth embodiment, a filter 48 is installed at the lower end of the separation cylinder 46 of the oil separator 38 to remove foreign matter from the separated oil. Otherwise, the construction is the same as the foregoing embodiment, and the description will not be repeated here.

The sixth embodiment also offers the same effects as those achieved by the fifth embodiment.

Embodiment 7

Figure 9:
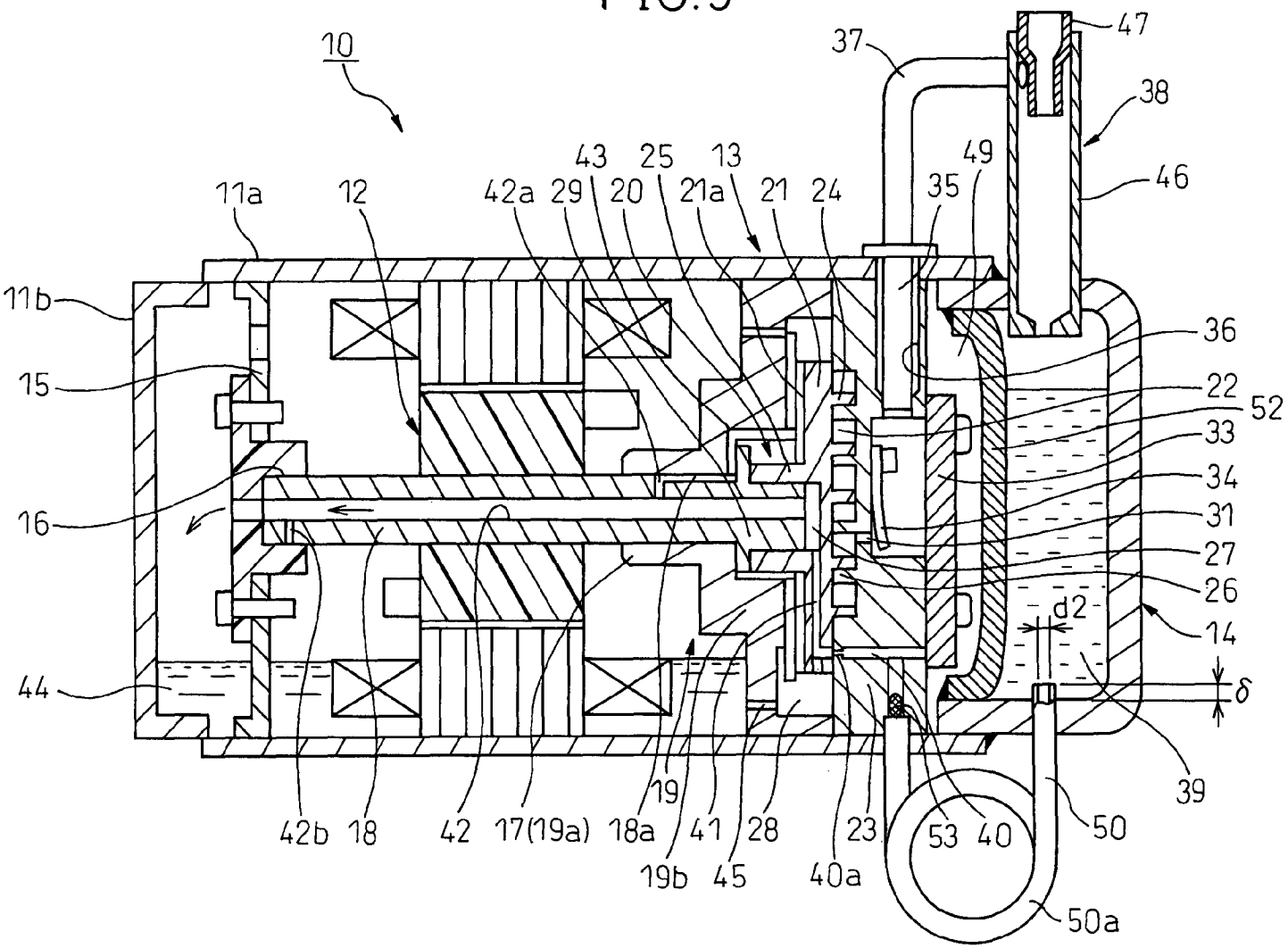
FIG. 9 is an explanatory cross-sectional view showing a seventh embodiment of a compressor according to the present invention.

FIG. 9 shows a compressor 10 according to a seventh embodiment of the present invention.

In the seventh embodiment, the oil feed pipe 50 is provided with a loop- or coil-shaped bent portion 50*a* so as not to connect the high-pressure oil storage chamber 39 to the oil return passage 40 in the compression mechanism unit 13 by the shortest path. By providing the bent portion 50*a* in the oil feed pipe 50, the high-temperature oil can be cooled, and the intake gas can be prevented from being heated by the high-temperature oil and degrading the efficiency. Otherwise, the construction is the same as the sixth embodiment, and the description will not be repeated here.

Embodiment 8

Figure 10:
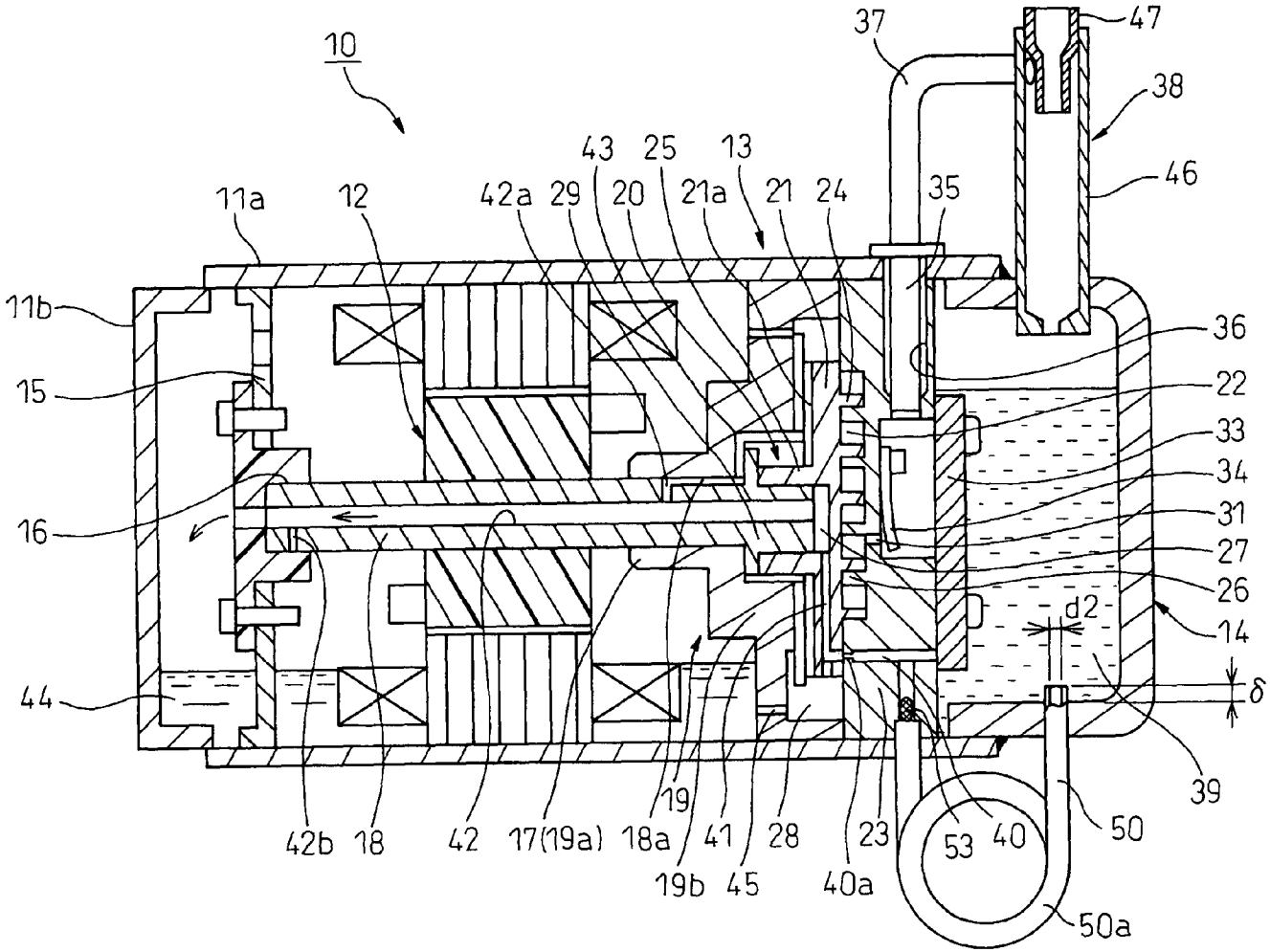
FIG. 10 is an explanatory cross-sectional view showing an eighth embodiment of a compressor according to the present invention.

FIG. 10 shows a compressor 10 according to an eighth embodiment of the present invention.

In the eighth embodiment, one end wall of the housing 11*a* which is thicker than the other outer walls is used as the outer wall of the high-pressure oil storage chamber 39. Further, the fixed scroll 23 in the compression mechanism unit 13 and the shielding wall 33 forming the discharge chamber 32 in the fixed scroll 23 are made to serve as a partition separating the high-pressure oil storage chamber 39, to further enlarge the capacity of the high-pressure oil storage chamber 39.

In this embodiment also, the space 36 is provided around the outer circumference of the discharge pipe 35 communicating between the discharge chamber 32 and the exterior of the housing 11*a*.

Further, as in the foregoing seventh embodiment, the oil feed pipe 50 is provided with a loop- or coil-shaped bent portion 50*a* so as not to connect the high-pressure oil storage chamber 39 to the oil return passage 40 in the compression mechanism unit 13 by the shortest path. By providing the bent portion 50*a* in the oil feed pipe 50, the high-temperature oil can be cooled, and the intake gas can be prevented from being heated by the high-temperature oil and degrading the efficiency. Otherwise, the construction is the same as the sixth embodiment, and the description will not be repeated here.

Embodiment 9

Figure 11:
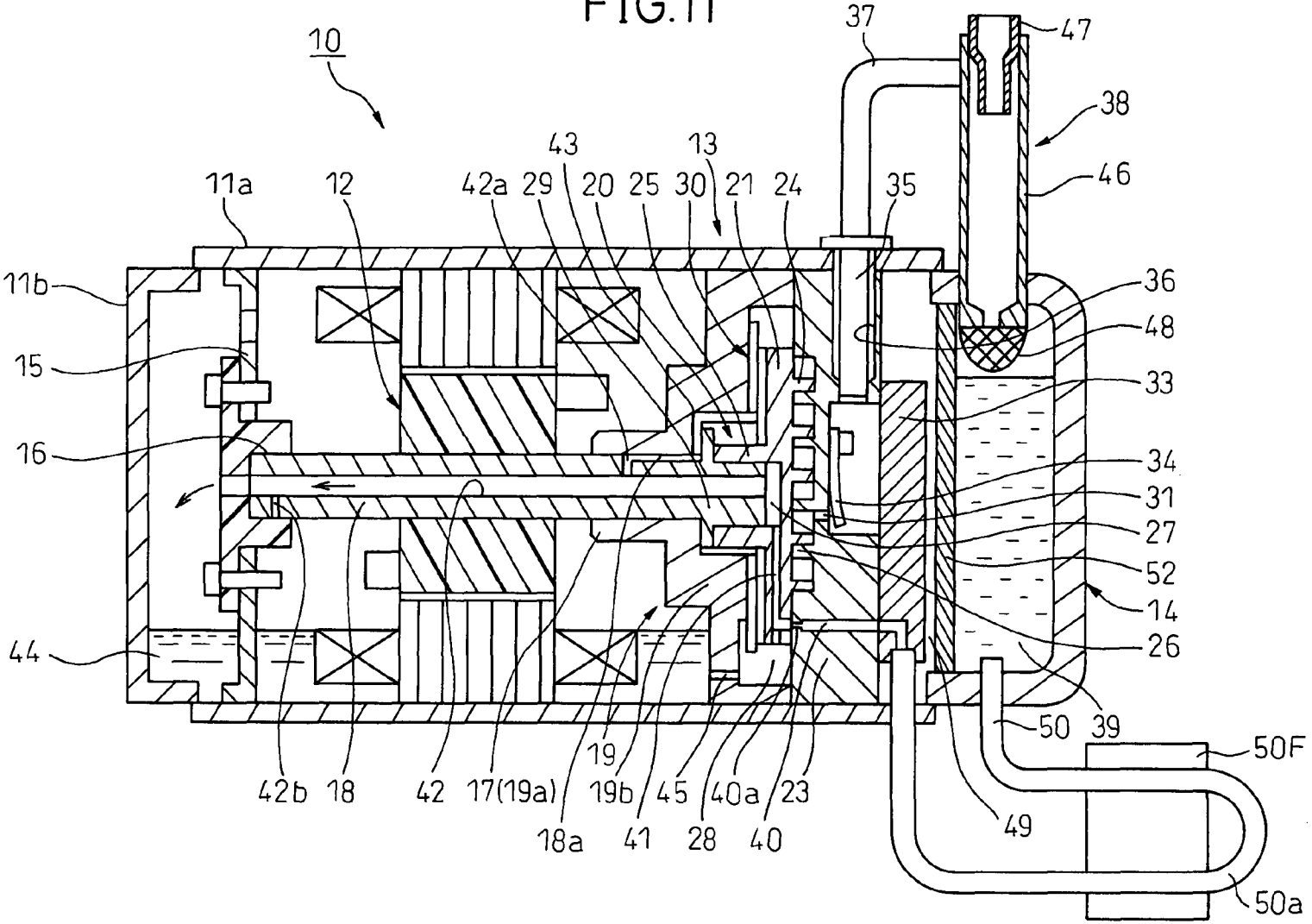
FIG. 11 is an explanatory cross-sectional view showing a ninth embodiment of a compressor according to the present invention.

FIG. 11 shows a compressor 10 according to a ninth embodiment of the present invention.

In the ninth embodiment, the oil feed pipe 50 connecting between the high-pressure oil storage chamber 39 in the seventh embodiment and the oil return passage 40 formed passing through the partition wall 33 and the fixed scroll 23 in the compression mechanism unit 13 is provided with a U-shaped bent portion 50*a* so as not to connect them by the shortest path, and the bent portion 50*a* is provided with heat sinking fins 50F for promoting heat dissipation from the high-temperature oil. This further facilitates the cooling of the high-temperature oil. Otherwise, the construction is the same as the seventh embodiment, and the description will not be repeated here.

Embodiment 10

Figure 12:
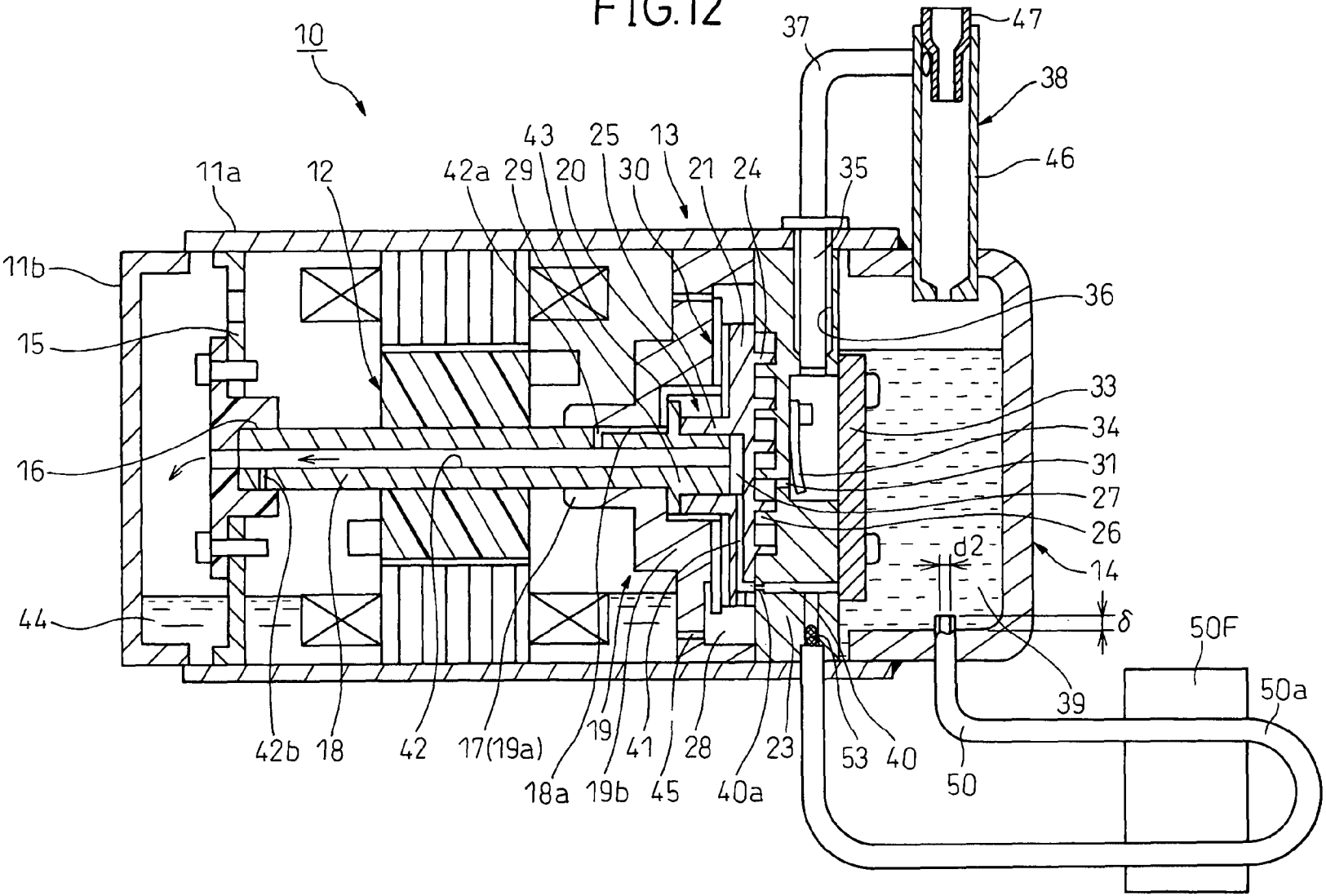
FIG. 12 is an explanatory cross-sectional view showing a 10th embodiment of a compressor according to the present invention.

FIG. 12 shows a compressor 10 according to a 10th embodiment of the present invention.

In the 10th embodiment, as in the ninth embodiment, the oil feed pipe 50 is provided with a U-shaped bent portion 50*a* so as not to connect the two components by the shortest path, and the bent portion 50*a* is provided with heat sinking fins 50F for promoting heat dissipation from the high-temperature oil.

Further, as in the eighth embodiment, one end wall of the housing 11*a* which is thicker than the other outer walls is used as the outer wall of the high-pressure oil storage chamber 39. Further, the fixed scroll 23 in the compression mechanism unit 13 and the shielding wall 33 forming the discharge chamber 32 in the fixed scroll 23 are made to serve as a partition separating the high-pressure oil storage chamber 39, to further enlarge the capacity of the high-pressure oil storage chamber 39. Accordingly, a sufficient amount of oil can be stored, and besides, the high-temperature oil can be cooled further efficiently. Otherwise, the construction is the same as the seventh embodiment, and the description will not be repeated here.

Embodiment 11

Figure 13:
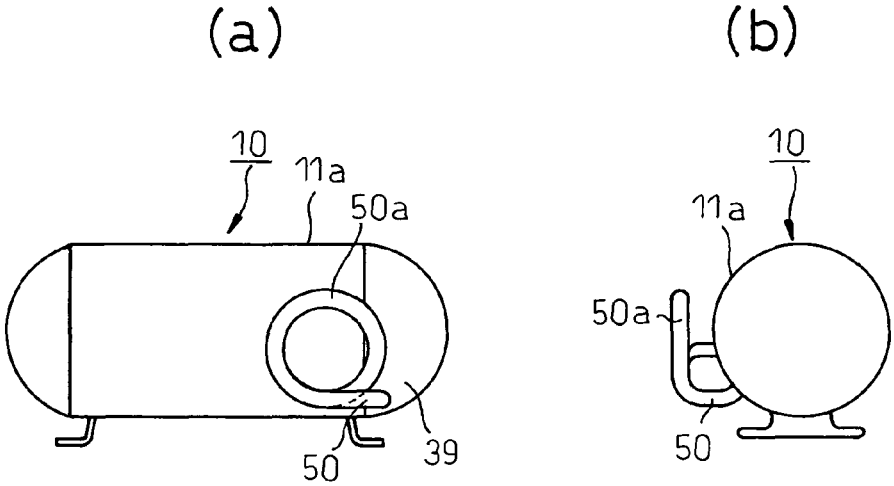
FIG. 13 is an external view of a compressor according to an 11th embodiment of the present invention, part (a) showing a front view and part (b) showing a side view.

FIG. 13 is an external view of a compressor 10 according to an 11th embodiment according to the present invention, part (a) showing a front view and part (b) showing a side view. In the 11th embodiment, the oil feed pipe 50 having a loop-shaped bent portion 50*a* is installed outside the container 1 and in the vicinity of the compression mechanism unit 2. This arrangement improves mountability of the compressor 10. The internal construction of the compressor 10 is the same as the first embodiment.

The purpose of installing the pipe "in the vicinity" is to enable the compressor to be mounted separately; in particular, when the pipe brought out from the bottom of the pressure container is curved along the side face of the container but not supported on the container surface by a bracket or the like, the pipe can be said to be installed in the vicinity. If the pipe is supported on the main body by a bracket, the pipe can still be said to be installed in the vicinity as long as the compressor can be mounted separately.

On the other hand, the condition in which the pipe is not installed in the vicinity refers to the condition in which the pipe is installed by going around the heat exchanger or other device or by being supported on such other device, making it difficult to mount the compressor separately.

Embodiment 12

Figure 14:
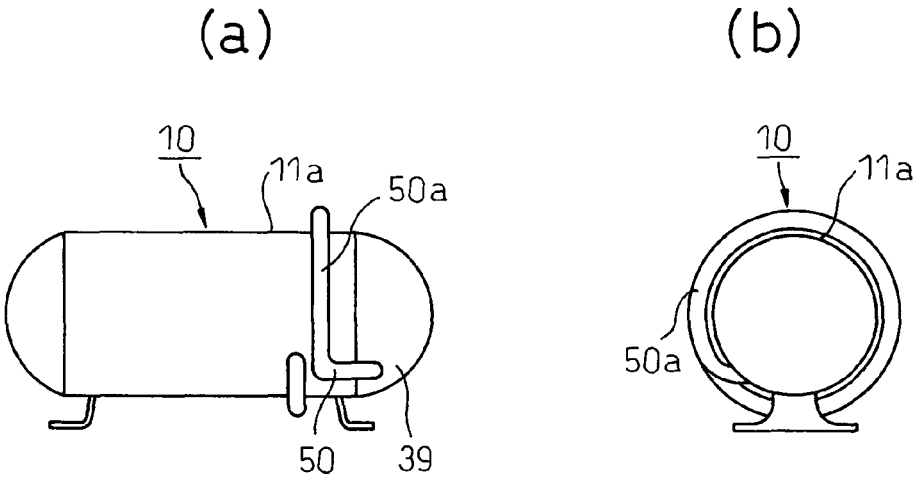
FIG. 14 is an external view of a compressor according to a 12th embodiment of the present invention, part (a) showing a front view and part (b) showing a side view.

FIG. 14 is an external view of a compressor 10 according to a 12th embodiment according to the present invention, part (a) showing a front view and part (b) showing a side view. In the 12th embodiment, the oil feed pipe 50 is installed with its loop-shaped bent portion 50*a* circling the outer circumference of the container 1 once, and the oil feed pipe 50 is disposed in the vicinity of the compression mechanism unit 2. This arrangement serves to prevent the mounting space of the compressor 10 from increasing, and further improves the mountability. The internal construction of the compressor 10 is the same as the first embodiment.

DESCRIPTION OF THE REFERENCE NUMERALS

10 . . . COMPRESSOR
11 . . . SEALED CONTAINER
11*a* . . . HOUSING
11*b* . . . THIRD CYLINDRICAL PORTION
12 . . . MOTOR UNIT
13 . . . COMPRESSION MECHANISM UNIT
14 . . . PRESSURE-RESISTANT CONTAINER
15 . . . SUPPORTING MEMBER
16 . . . SUB-BEARING
17 . . . MAIN BEARING
18 . . . SHAFT
18*a* . . . SHAFT GROOVE
19 . . . MIDDLE HOUSING
19*a*, 19*b*, 19*c* . . . CYLINDER
19*d* . . . DISC PORTION
19*e* . . . SCROLL SIDE DISC END FACE
20 . . . CRANK MECHANISM
21 . . . MOVING SCROLL
21*a* . . . MOVING SCROLL REAR FACE
22 . . . COMPRESSION CHAMBER
23 . . . FIXED SCROLL
24 . . . MOVING-SIDE SCROLL MEMBER
25 . . . BOSS
26 . . . FIXED-SIDE SCROLL MEMBER
27 . . . CRANK CHAMBER
28 . . . SCROLL ACCOMMODATING PORTION
29 . . . ECCENTRIC
30 . . . THRUST BEARING
31 . . . DISCHARGE PORT
32 . . . DISCHARGE CHAMBER
33 . . . SHIELDING WALL
34 . . . DISCHARGE VALVE
35 . . . DISCHARGE PIPE
36 . . . SPACE
37 . . . CONNECTING PIPE
38 . . . OIL SEPARATOR
39 . . . HIGH-PRESSURE OIL STORAGE CHAMBER
40 . . . OIL RETURN PASSAGE
41, 42 . . . OIL PASSAGE
42*a*, 42*b* . . . RADIALLY OUTWARDLY EXTENDING HOLE
43 . . . OIL GROOVE
44 . . . LOW-PRESSURE OIL STORAGE CHAMBER
45 . . . OIL RETURN HOLE
46 . . . SEPARATION CYLINDER
47 . . . SEPARATION PIPE
48 . . . FILTER
49 . . . SPACE
50 . . . OIL FEED PIPE
50*a* . . . BENT PORTION
50F . . . HEAT SINKING FIN
51 . . . OIL RECOVERY PIPE
52 . . . PARTITION WALL
53 . . . FILTER

What is claimed is:

1. A compressor constructed by enclosing a compression mechanism unit for compressing a refrigerant in a housing whose interior is held at a lower pressure than a discharge pressure, said compressor comprising:

an oil separator for separating oil from said refrigerant compressed by said compression mechanism unit; and a high-pressure oil storage chamber, located adjacent to said compression mechanism unit, for storing said oil separated by said oil separator, wherein at least a portion of said oil separator is provided outside said housing, wherein said high-pressure oil storage chamber is constructed from a pressure-resistant container whose wall thickness is greater than an outer wall forming said housing accommodating said compression mechanism unit, and within said housing, a space in which oil is not filled is formed between said compression mechanism unit and said pressure-resistant container forming said high-pressure oil storage chamber, wherein a partition wall forming a side wall of said high-pressure oil storage chamber at a side thereof that faces said compression mechanism unit is provided so as to form a space between said compression mechanism unit and said high-pressure oil storage chamber within said housing, and a portion of an oil return passage through which the oil stored in said high-pressure oil storage chamber is fed back to said compression mechanism unit is constructed as an oil feed pipe which is disposed outside said housing, wherein said partition wall is joined to said housing on an interior side thereof, and wherein said partition wall has a cross-sectional shape curved inwardly into said high-pressure oil storage chamber.

2. A compressor as claimed in claim 1, wherein an end portion of said compression mechanism unit is located inside the curved portion of said partition wall.

3. A compressor as claimed in claim 1, wherein the outer wall of said high-pressure oil storage chamber is formed so that an outer edge thereof can be fitted tightly into an inner circumferential edge of said housing at one axial end thereof, and said one end of said housing and an outer circumferential portion near said outer edge of said outer wall thus fitted are welded together, and wherein said partition wall is fitted in close contact with an inner circumferential surface of said outer edge of said outer wall, and a peripheral edge of said partition wall is welded around a periphery thereof where said partition wall is held in intimate contact with the inner circumferential surface of said outer edge of said outer wall.

* * * * *